US009756425B2

(12) United States Patent
Seade

(10) Patent No.: US 9,756,425 B2
(45) Date of Patent: Sep. 5, 2017

(54) BASEBALL-STYLE CAP WITH AMPLIFIED STEREO SPEAKERS

(71) Applicant: John G. Seade, Artesia, CA (US)

(72) Inventor: John G. Seade, Artesia, CA (US)

(73) Assignee: AUDIO WEAR TECHNOLOGY INC., Artesia, CA (US)

( * ) Notice: Subject to any disclaimer, the term of this patent is extended or adjusted under 35 U.S.C. 154(b) by 336 days.

(21) Appl. No.: 13/947,941

(22) Filed: Jul. 22, 2013

(65) Prior Publication Data

US 2013/0308801 A1 Nov. 21, 2013

Related U.S. Application Data

(63) Continuation of application No. 12/980,548, filed on Dec. 29, 2010, now Pat. No. 8,491,146, which is a continuation-in-part of application No. 12/194,792, filed on Aug. 20, 2008, now Pat. No. 7,862,194, which is a continuation of application No. 11/337,993, filed on Jan. 25, 2006, now abandoned.

(51) Int. Cl.
*H04R 5/02* (2006.01)
*A42B 1/24* (2006.01)

(52) U.S. Cl.
CPC ..... *H04R 5/02* (2013.01); *A42B 1/245* (2013.01)

(58) Field of Classification Search
CPC .. H04R 1/02; H04R 2201/023; H04R 5/0335; H04M 1/026; H04M 1/05
USPC ..... 381/301, 333, 385, 388
See application file for complete search history.

(56) References Cited

U.S. PATENT DOCUMENTS

| | | | | |
|---|---|---|---|---|
| 7,070,425 | B2 * | 7/2006 | Regen | H01R 13/4532 439/131 |
| 2004/0128737 | A1 * | 7/2004 | Gesten | 2/171 |
| 2005/0070225 | A1 * | 3/2005 | Lee | 455/41.3 |
| 2006/0182270 | A1 * | 8/2006 | Burns | 379/430 |
| 2006/0270450 | A1 * | 11/2006 | Garratt | A63B 24/0021 455/556.1 |

* cited by examiner

*Primary Examiner* — Alexander Jamal
(74) *Attorney, Agent, or Firm* — Loza & Loza, LLP; Julio Loza

(57) ABSTRACT

An embodiment of a baseball-style cap and stereo combination having a crown, a brim/bill, a sweatband, and one or more speakers concealed within the brim/bill is disclosed. The stereo components including a wireless receiver, an amplifier, and/or battery are concealed within an inner surface and/or inner space defined as the area between the lowermost inner surface area of the crown and the inner surface of the sweatband. The wireless receiver receivers audio signals from an external audio source and plays the audio via the one or more speakers.

17 Claims, 4 Drawing Sheets

FIG. 5
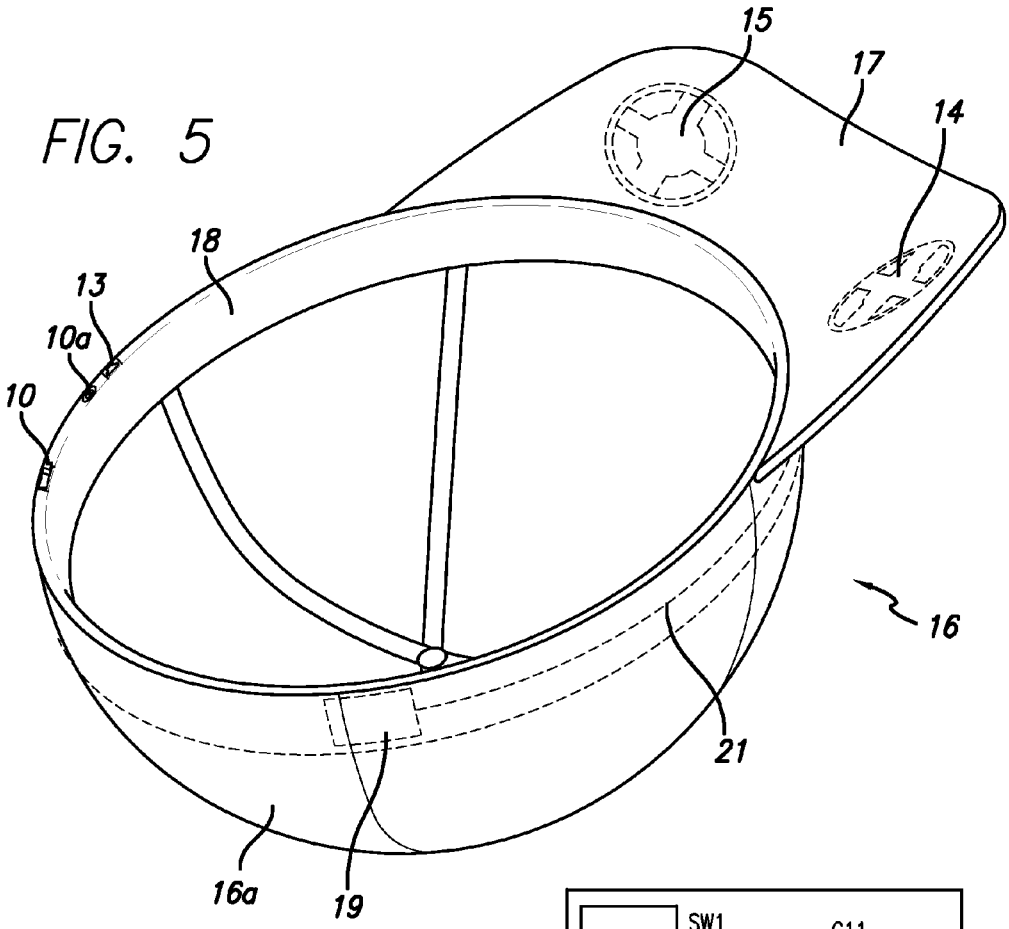
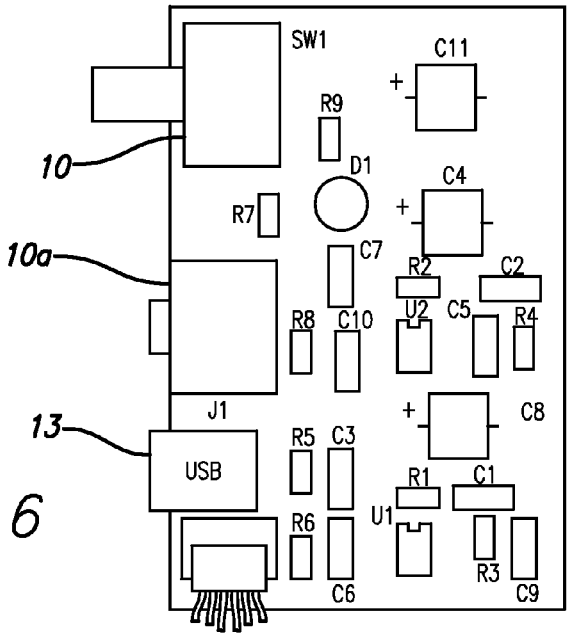
FIG. 6

BASEBALL-STYLE CAP WITH AMPLIFIED STEREO SPEAKERS

CLAIM OF PRIORITY UNDER 35 U.S.C. §120

The present Application is a continuation application of, and claims priority to, U.S. application Ser. No. 12/980,548 entitled "Baseball Style Cap with Amplified Stereo Speakers" filed Dec. 29, 2010, currently pending, which is a continuation-in-part of U.S. application Ser. No. 12/194,792 entitled "Baseball Style Cap with Amplified Stereo Speakers" filed Aug. 20, 2008, issued as U.S. Pat. No. 7,862,194, which claims priority to U.S. application Ser. No. 11/337,993 entitled "Baseball Style Cap with Amplified Stereo Speakers" filed Jan. 25, 2006, now abandoned, both of which are expressly incorporated by reference herein.

FIELD OF INVENTION

The present invention relates to combined headgear and electronic means to provide music. More specifically, the invention relates to a combined baseball type cap and music signal provided to the speakers integrated as part of the cap.

BACKGROUND OF INVENTION

U.S. Design Pat. 321,581 to Li discloses an ornamental combined cap and radio.

U.S. Pat. No. 5,410,746 to Gelber discloses headgear, such as a cap having a crown, a brim and an internal sweatband or flap, combined with an electronic receiving device, such as a radio, which is connected to the inner surface of the flap by a first double sided adhesive strip.

U.S. Pat. No. 5,510,961 to Peng discloses a cap structure with sound recording and generating means and warning lights includes digitalized sound recording and releasing means and light emitting diodes on a visor.

U.S. Pat. No. 7,031,068 to Himmele disclose a hands-free binocular visor headgear for viewing sporting and other events where it is desirable to use binoculars but also have the free use of the hands.

When using mobile audio devices, it is helpful to deliver the sound as close as possible to the user's ears for better audio perception. However, using earbuds or headphones to deliver the sound also tends to block the listener from perceiving other sounds, such as emergency alarms, phone rings, or another person's words. Consequently, such conventional forms of audio delivery may place the user (and others around him/her) in danger if a warning or alarm is not heard due to the use of earbuds or earphones.

SUMMARY OF INVENTION

One embodiment provides a baseball-style cap having amplified stereo speakers. The baseball-style may include (a) a crown adapted to fit a head of a user; (b) a horizontally extending brim/bill attached to the crown; (c) a sweatband secured to an inner surface of the crown by at least one edge; (d) a rechargeable power source positioned within a space defined by an area between a lowermost inner surface area of the crown and an inner surface of the sweatband; (e) a circuit board having at least one USB port adapted to receive a USB cable, the circuit board positioned within the space defined by the area between the lowermost inner surface of the crown and the inner surface of the sweatband; (f) a stand-alone amplifier positioned within the sweatband configured to amplify audio signals originating from an adjacent external signal source; and/or (g) at least two stand-alone speakers integrated within the brim/bill with their direction of sound propagation pointed downward from the brim/bill, the speakers having a thickness equal to or less than the thickness of the brim/bill so that the speakers are concealed within the thickness of the brim/bill wherein the baseball style cap is adapted to receive a signal from an external music signal generator.

The rechargeable power source may be a battery that is dimensioned to be positioned within a space between a lowermost inner surface of the crown and an inner surface of the sweatband such that it is substantially concealed within a thickness of the lowermost inner surface of the crown and the inner surface of the sweatband. The battery may be affixed within the space by a securing means. A first wire may connect the battery to the circuit board, the first wire positioned within the space defined by the area between the lowermost inner surface of the crown and the inner surface of the sweatband. The battery may be recharged by coupling a USB cable to the USB port.

A second wire may connect one speaker to the circuit board, at least a portion of the second wire positioned within the space defined by the area between the lowermost inner surface of the crown and the inner surface of the sweatband and at least a portion of the second wire is positioned within the brim/bill. A third wire may connect one speaker to the circuit board, at least a portion of the third wire positioned within the space defined by the area between the lowermost inner surface of the crown and the inner surface of the sweatband and at least a portion of the second wire is positioned within the brim/bill.

The amplifier may have an ON/OFF switch located on the side of the amplifier, the ON/OFF switch protruding through an edge of the sweatband. The amplifier may contain an LED light protruding through the edge of the sweatband, the LED light adapted to illuminate a blue light when the ON/OFF switch is turned ON. The amplifier may include a female stereo audio jack connector, the female stereo audio jack connector configured to connect to a male connector of an external music signal generator. The external signal generator may include stereo audio cable means, the stereo audio cable means having a male connector to fit in the female stereo audio jack connector on the amplifier. A stereophonic signal may be provided to the amplified stereo speakers to provide stereophonic music. The external music signal generator may be one of a compact disc player, MP3 player, AM/FM radio, a device with a 3.5 mm jack or a device that can provide stereophonic music signal. The stand-alone amplifier includes a receiver to wirelessly receive the audio signals from the adjacent external signal source.

In another embodiment, a baseball style cap is provided having integrated stereo speakers, comprising: (a) a crown adapted to fit a head of a user; (b) a horizontally extending brim/bill attached to the crown; (c) a sweatband secured to an inner surface of the crown by at least one edge; (d) a rechargeable power source positioned within a space defined by an area between a lowermost inner surface area of the crown and an inner surface of the sweatband; (e) a circuit board having at least one USB port adapted to receive a USB cable, the circuit board positioned within the space defined by the area between the lowermost inner surface of the crown and the inner surface of the sweatband; (f) a stand-alone amplifier positioned within the sweatband configured to amplify audio signals originating from an adjacent external signal source; (g) at least two stand-alone speakers integrated within the brim/bill with their direction of sound propagation pointed downward from the brim/bill, the speakers having a thickness equal to or less than the thickness of the brim/bill so that the speakers are concealed within the thickness of the brim/bill wherein the baseball style cap is adapted to receive a signal from an external music signal generator; and/or (h) means to provide external audio signals to the speakers.

BRIEF DESCRIPTION OF DRAWINGS

FIG. 5 is a bottom view of the baseball-style cap and stereo combination of FIG. 1.

FIG. 6 illustrates a circuit board for use with the baseball-style cap and stereo combination of FIG. 1 according to an embodiment of the invention.

DETAILED DESCRIPTION

Figure 1:
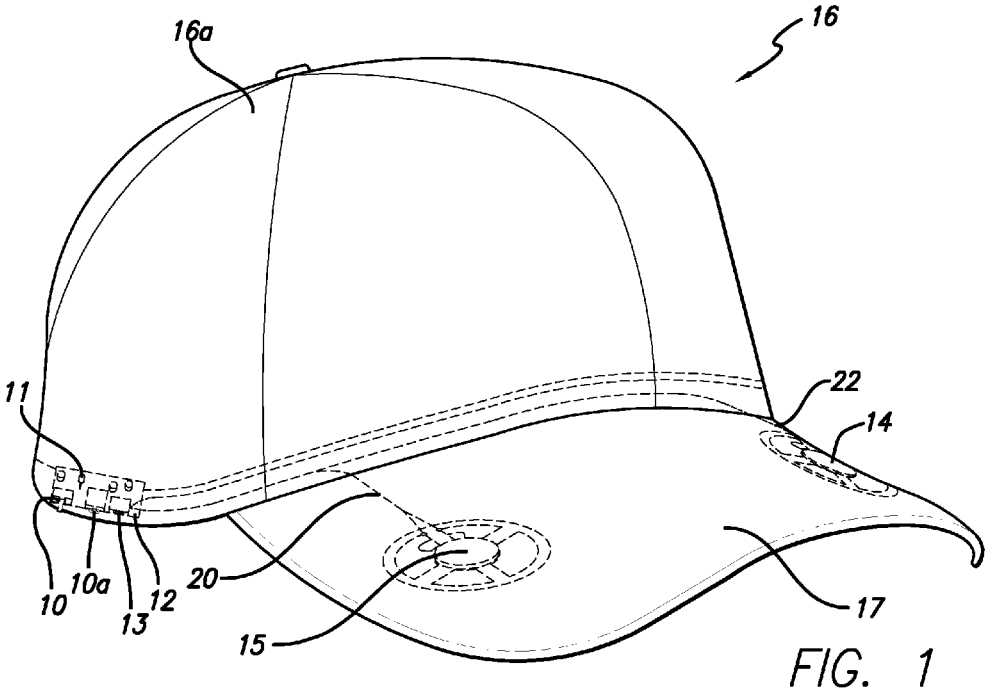
FIG. 1 is a perspective view of a baseball-style cap and stereo combination according to an embodiment of the invention.

FIG. 1 is a perspective view of a baseball-style cap and stereo combination according to an embodiment of the invention. The cap may be of any conventional design and manufacture and, in the embodiment shown, includes a cap crown 16*a*, a brim/bill 17 and a sweatband 18 (shown in phantom and illustrated in FIG. 5) within an inner periphery of the lowermost portion of the cap crown 16*a*. According to embodiments of the invention, the baseball-style cap combination 16 includes stereo low profile micro-miniature speakers 14 and 15 embedded within brim/bill 17. The speakers 14, 15 may be connected to a circuit board (not shown, see FIG. 6) by wires 20 and 22. Components of the circuit board visible in FIG. 1 include an audio stereo jack 10*a* (explained in more detail below), a USB port 13 (explained in more detail below), and an ON/OFF switch 10 to power an amplifier 12. An LED light 11 indicates when the amplifier 12 is turned ON.

According to embodiments of the invention, only one edge of the sweatband 18 is sewn to the crown enabling the sweatband to be pulled away from the crown 16*a* to enable access to the inner surface and/or inner space defined as the area between the lowermost inner surface area of the crown 16*a* and the inner surface of the sweatband 18 when pulled apart from one another. This enables a wire 21 (illustrated in FIG. 4) connecting a battery to the circuit board (explained in more detail below) to thread within the inner surface/space of the sweatband 18. This also allows wires 20, 22 from the amplifier 12 to similarly thread within the inner surface/space of the sweatband 18 to the speakers 14 and 15 thereby connecting these components.

Figure 2:
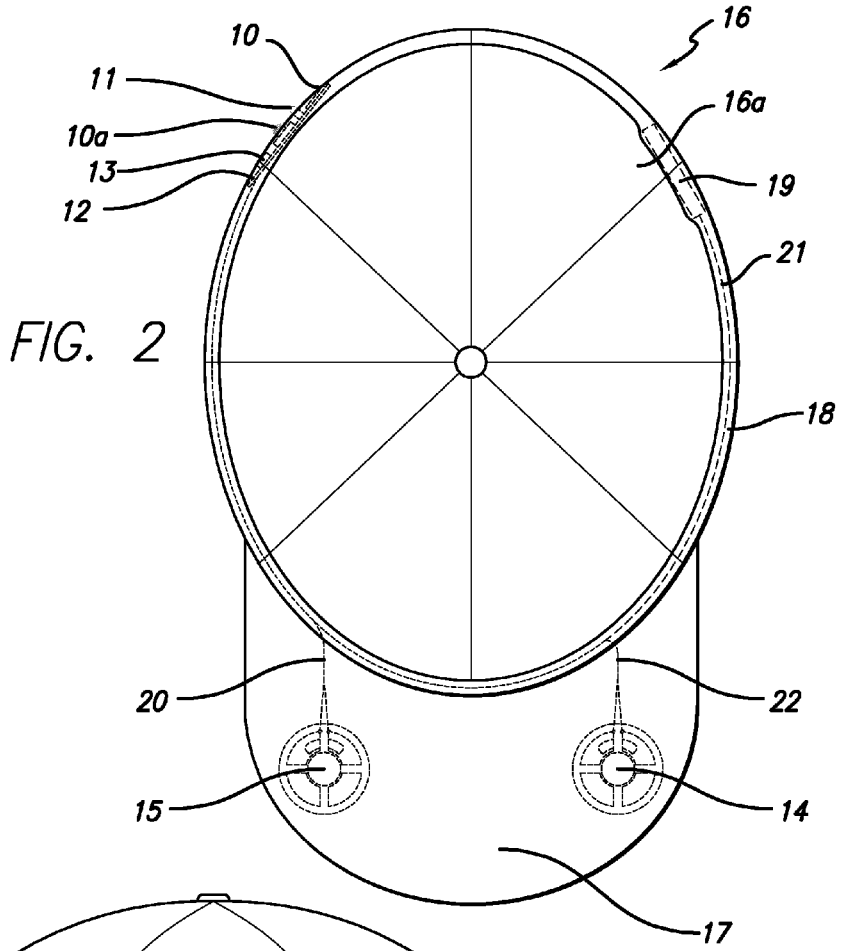
FIG. 2 is a top view of the baseball-style cap and stereo combination of FIG. 1.

FIG. 2 is a top view of the baseball-style cap and stereo combination 16 of FIG. 1. In one embodiment, speakers 14 and 15 are enclosed by the cloth that covers the brim/bill 17 during assembly. In some embodiments, speakers 14 and 15 are "low profile micro miniature speakers" with rare earth magnets. The speakers 14 and 15 may be sufficiently thin to fit completely within the thickness of the brim/bill 17. For example, the brim/bill 17 may be between ⅛ and 3/16 of an inch thick. Due to their thinness, the speakers 14 and 15 may be completely concealed within the brim/bill 17 and may be covered by an exterior cloth of the brim/bill 17. Also shown in FIG. 2 and within sweatband 18 are the ON/OFF switch 10, the stereo jack 10*a*, the LED light 11, the amplifier 12 and the USB port 13 in one area and a power source, or battery 19, in another area (explained in more detail below).

Figure 3:
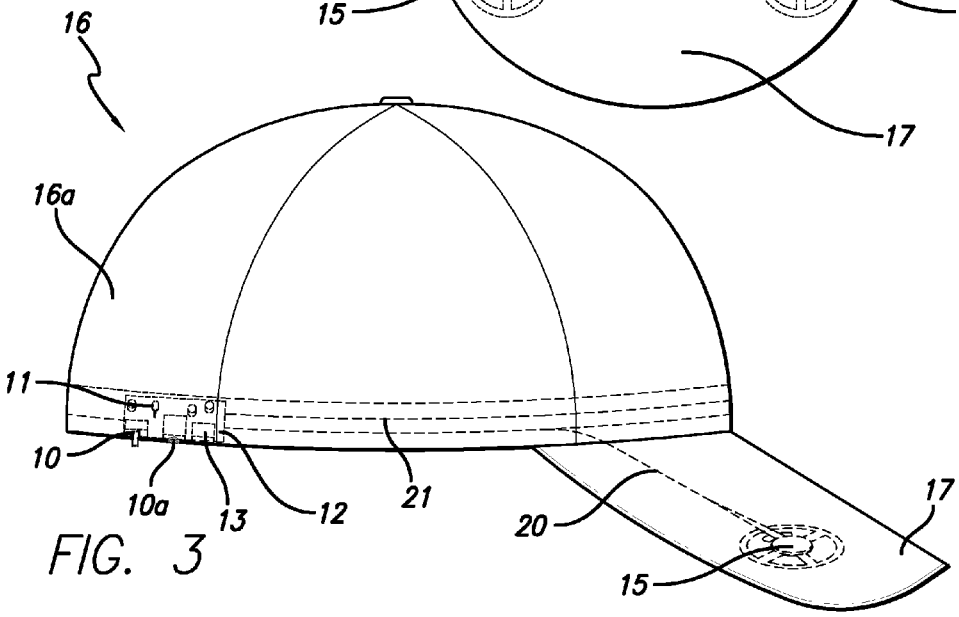
FIG. 3 is a left-side view of the baseball-style cap and stereo combination of FIG. 1.

FIG. 3 is a left-side view of the baseball-style cap and stereo combination 16 of FIG. 1. As shown, FIG. 3 illustrates baseball-style cap combination 16 including stereo speaker 15, the amplifier 12, the ON/OFF switch 10, the audio stereo jack 10*a*, and the LED light 11 that, when illuminated, indicates when the amplifier 12 is turned ON. FIG. 3 also illustrates the crown 16*a*, the brim/bill 17 and the connecting wire 20.

Figure 4:
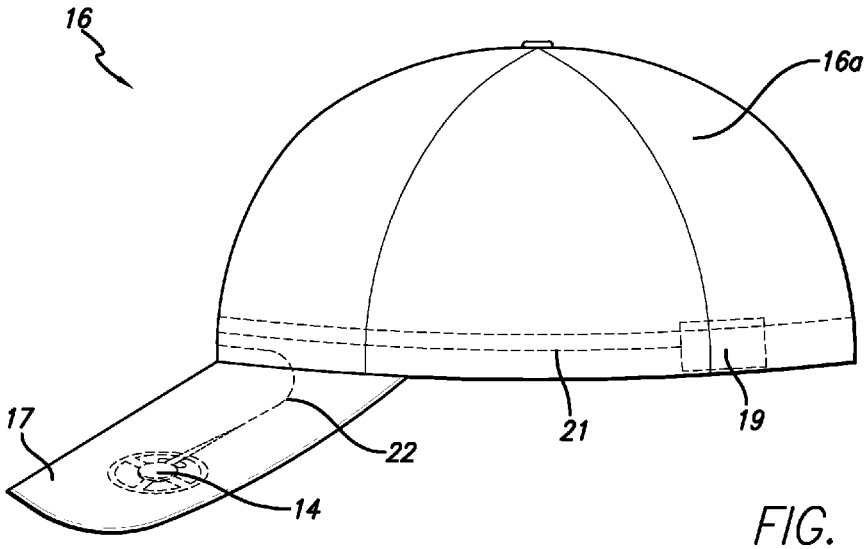
FIG. 4 is a right-side view of the baseball-style cap and stereo combination of FIG. 1.

FIG. 4 is a right-side view of the baseball-style cap and stereo combination 16 of FIG. 1. As shown, FIG. 4 illustrates baseball-style cap combination 16 including stereo speaker 14 and the battery 19 (in phantom). In one embodiment, the battery 19 is affixed within the inner surface/space as the area between the lowermost inner surface area of the crown 16*a* and the inner surface of the sweatband 18 when pulled apart from one another. The battery 19 may be affixed therein by use of a securing means such as VELCRO, snaps, buttons or any other equivalent thereof. Such size allows for concealment (and therefore protection from the elements and protection from bodily fluids, e.g., sweat from the user) of the battery 19. Additionally, the battery 19 according to embodiments of the invention is much more lightweight and less bulky compared to conventional batteries allowing for the positioning of the battery 19 as described previously without compromising the user's comfort since the sweatband 18 is typically in contact with the user's head.

According to embodiments of the invention, the battery 19 may be a rechargeable battery such as a lithium ion battery. In a specific embodiment, the battery 19 has at least the following features: battery rated at 3.7 Volts to 1000 mAh; built-in over/under voltage protection circuit; over-voltage trip point at approximately 4.275 Volts; under-voltage trip point at approximately 2.30 Volts; over-current protection at approximately 1.7 Amps; a weight of about 0.56 ounces; and dimensions of about 2 and 1/16 inches in length, 1 and ⅜ inches in width and 3/16 inches in depth. In this view there is also seen brim/bill 17, the top of the stereo speaker 14 and the wire 22 to a circuit board (not shown, see FIG. 6).

FIG. 5 is a bottom view of the baseball-style cap and stereo combination 16 of FIG. 1. As shown, FIG. 5 illustrates the baseball-style cap combination 16 including the crown 16*a*, the brim/bill 17, the sweatband 18, the ON/OFF switch 10, an audio stereo jack 10*a* and speakers 14 and 15. In some implementations, the cap may further include a wireless receiver, such as a Bluetooth connection that allows reception of audio signals, e.g., from a nearby digital music device.

As can be perceived from FIGS. 2 and 5, the thickness and/or dimension of the battery 19 may such that it fits within the thickness between the lowermost inner surface area of the crown 16*a* and the inner surface of the sweatband 18 which may be approximately ⅜" thick. Therefore, the battery 19 can be substantially concealed/housed within this space between the lowermost inner surface area of the crown 16*a* and the inner surface of the sweatband 18.

FIG. 6 illustrates a circuit board for use with the baseball-style cap and stereo combination 16 of FIG. 1 according to an embodiment of the invention. As shown, FIG. 6 illustrates a circuit board including the ON/OFF switch 10, the audio stereo jack 10*a* and the USB port 13 among other components generally incorporated within a circuit board. According to embodiments of the invention, the circuit board may be configured to receive a connector from an outside audio device via stereo jack 10*a*. According to embodiments of the invention, the USB port 13 is adapted to receive a USB cable such as known by those of ordinary skill in the art. In this manner, the rechargeable battery 19 may be recharged without removal from the cap 16. In one embodiment, the circuit board is configured to fit within the sweatband 18 of the baseball-style cap 16. Such size allows for concealment (and therefore protection from the elements and protection from bodily fluids, e.g., sweat from the user) of the circuit 12 while providing an adjustable means to amplify sound emanating from the speakers 14 and 15.

Figure 7:
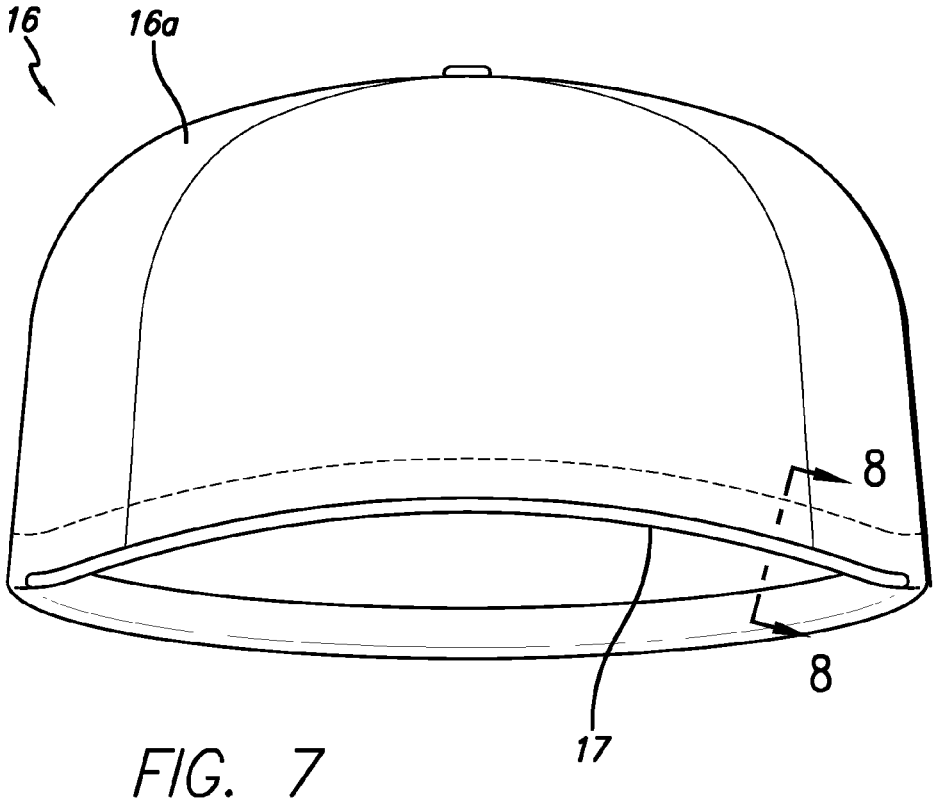
FIG. 7 is a front view of the baseball-style cap and stereo combination of FIG. 1.

FIG. 7 is a front view of the baseball-style cap and stereo combination 16 of FIG. 1. As shown, FIG. 7 illustrates the baseball-style cap combination 16 including the cap crown 16*a* and the brim/bill 17. Advantageously, the speakers 14 and 15 cannot be viewed by an on-looker because they are low-profile micro miniature speakers and substantially or completely incorporated within the brim/bill 17. Another benefit of low-profile speakers is that the speakers 14 and 15 will not block the view of the user when wearing the baseball-style cap combination 16 due to their low- to no-profile configuration (see FIG. 8 and accompanying text).

Figure 8:
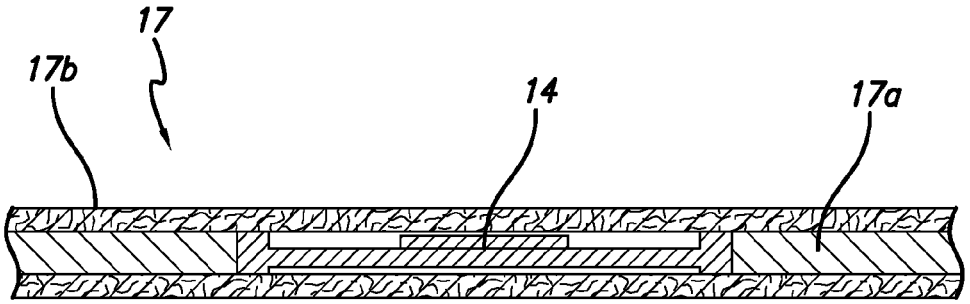
FIG. 8 is a cross-section of the baseball-style cap combination of FIG. 7 taken along lines 8-8.

FIG. 8 is a cross-section of the baseball-style cap combination of FIG. 7 taken along lines 8-8. As shown, FIG. 8 illustrates the brim/bill 17 having an inner portion 17*a* and an outer portion 17*b*. In some embodiments, inner portion 17*a* comprises injected plastic or equivalent and outer portion 17*b* comprises a covering such as porous audio cloth or equivalent. In one method of manufacturing, plastic is injected into a molding to form the brim/bill 17 leaving an opening for a speaker to be positioned therein. FIG. 8 illustrates the speaker 14 within inner portion 17*a* of the brim/bill 17. As shown, the speaker 14 is substantially or completely confined within inner portion 17*a*. Also, because the speakers 14 and 15 are positioned within the brim/bill 17, the projection of sound emanating therefrom is generally towards the front of the user's face rather than adjacent to the user's ears. In this respect, the user's ears are protected from sounds with too high of a frequency or decibel which may cause damage to the user's ears.

One advantage of positioning the speakers 14 and 15 in the brim/bill 17 is that the user's ears are not blocked or obstructed by earbuds or earphones. Therefore, the user can listen to desired audio via the speakers 14 and 15 while still being able to hear alarms, warnings, and/or another person's voice. For example, while a user is bicycling he/she may listen to music over the speakers 14 and 15 while still being able to listen to listen to ambulance sirens and car warning honks.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

What is claimed is:

1. A baseball-style cap, comprising:

a crown adapted to fit a head of a user;

a horizontally extending brim/bill attached to the crown;

a sweatband secured to an inner surface of the crown by at least one edge;

a rechargeable power source positioned within a space defined by an area between a lowermost inner surface area of the crown and an inner surface of the sweatband;

a circuit board including a wireless receiver adapted to receive audio signals from an external device, the circuit board positioned within the space defined by the area between the lowermost inner surface of the crown and the inner surface of the sweatband;

at least one stand-alone speaker integrated within the brim/bill with the direction of sound propagation pointed downward from the brim/bill, the at least one stand-alone speaker having a thickness equal to or less than the thickness of the brim/bill so that the speaker is concealed within the thickness of the brim/bill and enclosed by a cloth that covers the brim/bill wherein the baseball style cap is adapted to receive an audio signal via the circuit board, wherein a first wire connects the rechargeable power source to the circuit board, and wherein a second wire connects one speaker to the circuit board, at least a portion of the second wire positioned within the space defined by the area between the lowermost inner surface of the crown and the inner surface of the sweatband and at least a portion of the second wire is positioned within the brim/bill and wherein the circuit board further includes an ON/OFF switch, a stereo jack, and a USB port accessible from a lowermost outer portion of the crown.

2. The baseball-style cap of claim 1 wherein the rechargeable power source is a battery.

3. The baseball-style cap of claim 2 wherein the battery is dimensioned to be positioned within a space between a lowermost inner surface of the crown and an inner surface of the sweatband such that it is substantially concealed within a thickness of the lowermost inner surface of the crown and the inner surface of the sweatband.

4. The baseball-style cap of claim 3 wherein the battery is affixed within the space by a securing means.

5. The baseball-style cap of claim 3 wherein the first wire is positioned within the space defined by the area between the lowermost inner surface of the crown and the inner surface of the sweatband.

6. The baseball-style cap of claim 1 wherein a third wire connects one speaker to the circuit board, at least a portion of the third wire positioned within the space defined by the area between the lowermost inner surface of the crown and the inner surface of the sweatband and at least a portion of the second wire is positioned within the brim/bill.

7. The baseball-style cap of claim 1 further comprising:

a universal serial bus (USB) port, wherein when a USB cable is connected to the USB port, the battery is recharged.

8. The baseball-style cap of claim 1, further comprising:

an audio amplifier configured to amplify audio signals received via the wireless receiver wherein the audio amplifier is positioned within the sweatband.

9. The baseball-style cap of claim 8, wherein the at least one stand-alone speaker includes a first speaker and a second speaker, and the audio amplifier is adapted to generate a stereophonic signal and provide it to the first and second speakers.

10. A baseball style cap having integrated stereo speakers, comprising:

a crown adapted to fit a head of a user;

a horizontally extending brim/bill attached to the crown;

a sweatband secured to an inner surface of the crown by at least one edge;

a rechargeable power source positioned within a space defined by an area between a lowermost inner surface area of the crown and an inner surface of the sweatband;

a circuit board having at least one USB port adapted to receive a USB cable, the circuit board positioned within the space defined by the area between the lowermost inner surface of the crown and the inner surface of the sweatband;

a wireless receiver adapted to receive audio signals from an external source, the wireless receiver positioned within the space defined by the area between the lowermost inner surface of the crown and the inner surface of the sweatband;

an amplifier positioned within the sweatband configured to amplify audio signals received via the wireless receiver; and at least two stand-alone speakers integrated within the brim/bill with their direction of sound propagation pointed downward from the brim/bill, the speakers having a thickness equal to or less than the thickness of the brim/bill so that the speakers are concealed within the thickness of the brim/bill and enclosed by a cloth that covers the brim/bill wherein the baseball style cap is adapted to receive a signal from the amplifier, and wherein a wire connects the at least two stand-alone speakers to the circuit board, at least a portion of the wire positioned within the space defined by the area between the lowermost inner surface of the crown and the inner surface of the sweatband and at least a portion of the wire is positioned within the brim/bill and wherein the circuit board further includes an ON/OFF switch, a stereo jack, and a USB port accessible from a lowermost outer portion of the crown.

11. The baseball-style cap of claim 10 wherein the rechargeable power source is a battery, the battery dimensioned to be positioned within a space between a lowermost inner surface of the crown and an inner surface of the sweatband such that it is substantially concealed within a thickness of the lowermost inner surface of the crown and the inner surface of the sweatband.

12. The baseball-style cap of claim 11 wherein the battery is affixed within the space by a securing means.

13. The baseball-style cap of claim 10, wherein the at least two stand-alone speakers are substantially concealed by an exterior cloth of the brim/bill and wherein the thickness of the speakers is less than 3/16 of an inch.

14. The baseball-style cap of claim 13, wherein the exterior cloth includes a porous audio cloth.

15. The baseball-style cap of claim 10, wherein the brim/bill extends from a front of the crown of the baseball-style cap.

16. The baseball-style cap of claim 10, wherein the brim/bill includes an inner portion and an outer portion, wherein the inner portion includes injected plastic forming at least one opening for positioning of one or more of the stand-alone speakers and wherein the outer portion includes an external cloth covering.

17. The baseball-style cap of claim 10, wherein the wireless receiver includes a Bluetooth wireless receiver for reception of the audio signals from the external device.

* * * * *